US008850934B2

(12) United States Patent
Baker

(10) Patent No.: US 8,850,934 B2
(45) Date of Patent: Oct. 7, 2014

(54) SCREWDRIVER BLADE WITH INCLINED DRIVE SURFACES AND METHOD OF MANUFACTURING

(75) Inventor: David R. Baker, Crowley, TX (US)

(73) Assignee: David Baker, Inc., Crowley, TX (US)

( * ) Notice: Subject to any disclaimer, the term of this patent is extended or adjusted under 35 U.S.C. 154(b) by 250 days.

(21) Appl. No.: 13/453,715

(22) Filed: Apr. 23, 2012

(65) Prior Publication Data

US 2012/0279364 A1 Nov. 8, 2012

Related U.S. Application Data

(60) Provisional application No. 61/483,427, filed on May 6, 2011.

(51) Int. Cl.
*B25B 15/00* (2006.01)
*B21K 5/00* (2006.01)

(52) U.S. Cl.
CPC ..... *B25B 15/007* (2013.01); *B21K 5/00* (2013.01)
USPC ..... 81/436; 76/117

(58) Field of Classification Search
CPC .... B25B 15/02; B25B 15/005; B25B 15/007; B25B 15/008; B21K 5/00; B21K 5/16
USPC ..... 81/436, 441; 76/117, 119
See application file for complete search history.

(56) References Cited

U.S. PATENT DOCUMENTS

| | | | | | |
|---|---|---|---|---|---|
| 3,175,593 | A | * | 3/1965 | Launay | 81/436 |
| 4,625,598 | A | * | 12/1986 | Wolfram | 81/436 |
| 4,977,800 | A | * | 12/1990 | Colvin | 81/436 |
| 5,259,279 | A | * | 11/1993 | Strauch | 81/436 |
| 5,269,209 | A | | 12/1993 | Baker | |
| 5,461,944 | A | * | 10/1995 | Ciumaga | 76/119 |
| 6,029,549 | A | | 2/2000 | Baker | |
| 6,397,710 | B1 | | 6/2002 | Baker | |
| 2009/0165604 | A1 | * | 7/2009 | Macor | 81/436 |
| 2009/0165605 | A1 | * | 7/2009 | Macor | 81/436 |

* cited by examiner

*Primary Examiner* — David B Thomas
(74) *Attorney, Agent, or Firm* — Bracewell & Giuliani LLP

(57) ABSTRACT

A screwdriver blade has faces formed on front and back sides of a shank. Each face has a drive surface extending from each side edge inward toward a longitudinal axis. Each drive surface is inclined relative to a plane containing the axis and bisecting each of the side edges. A thickness of the blade increases from the shank distal end. Each of the drive surfaces appears curved when viewed in a distal end view. Each of the drive surfaces extends from the shank distal end to a face proximal end. A central portion between each of the drive surfaces may also appear curved when viewed in a distal end view, or it may be flat. The drive surfaces and the central portion may be formed at a single radius of curvature. The central portion may have a increasing width from the distal end or it may have a constant width.

18 Claims, 7 Drawing Sheets

SCREWDRIVER BLADE WITH INCLINED DRIVE SURFACES AND METHOD OF MANUFACTURING

CROSS-REFERENCE TO RELATED APPLICATION

This application claims priority to provisional application 61/483,427, filed May 6, 2011.

FIELD OF DISCLOSURE

This disclosure relates in general to screwdrivers, in particular to a screwdriver blade that has surfaces that are curved to facilitate driving of a slotted screw.

BACKGROUND

Conventional flat screwdriver blade tips have a wedge shape, with flat front and back sides inclining toward each other to a distal end. A screw for a flat screwdriver blade tip has a slot with walls that are almost parallel. The portion of the blade tip that fits into the slot is smaller in thickness than the distance between the walls of the slot. When torque is applied, the blade tip rotates slightly relative to the slot, resulting in a point of line t-point of line contact between each side of the blade and each slot wall. The contact is normally at the top edges of the slot, often creating deformation to the slot when torque is applied. The screwdriver may also cam-out or ride up and out of the screw slot because of the small surface area contact and diverging sides of the blade tip.

Various types of specially configured screwdriver blades and screws have been proposed to increase surface contact between the blade tip and the slot. In these designs, the screwdriver can normally only be used with the specially designed screw slots. The screwdrivers designed to fit with a specially designed screw slot would not work well with a conventional straight slot screw.

SUMMARY

The screwdriver blades disclosed herein each have a shank with a shank proximal end, a shank distal end and a longitudinal axis. A face is formed on at least a front side of the shank, extending from the shank distal end toward the shank proximal end. The face has two side edges. A drive surface extends from each side edge inward toward the longitudinal axis. Each drive surface is inclined relative to a plane containing the axis and bisecting each of the side edges. A thickness of the blade measured from each drive surface to a back side of the shank increases from the shank distal end toward the shank proximal end. A thickness of the blade measured equidistant between the side edges to the back side of the shank increases at a same rate as the thickness of the blade measured from each drive surface to the back side.

In some embodiments, each of the drive surfaces are curved when viewed in a distal end view and straight when viewed in a side edge view. Each of the drive surfaces may extend from the shank distal end to a face proximal end.

In some embodiments, a central portion between each of the drive surfaces is also curved when viewed in the distal end view and flat or curved when viewed in a side edge view. The drive surfaces and the central portion may be formed at a single radius of curvature.

The side edges of the blade tip portion may diverge from each other from the shank distal end toward the shank proximal end. In some embodiments, each drive surface has an inner margin. The central portion is located between the drive surfaces and joins the inner margins. Each inner margin is a straight line that may be parallel to a closest one of the side edges when viewed in a front view, thereby defining a constant width for each of the drive surfaces. Alternately, the straight margin lines may be parallel to each other, thereby defining an increasing width portion for each of the drive surfaces from the shank distal end toward the shank proximal end.

In one embodiment, when viewed in a side edge view, the face curves away from the longitudinal axis in an increasing amount from the shank distal end to a proximal end of the face.

Two manufacturing methods are disclosed. In each method, a metal forming tool is provided with two engaging surfaces, each engaging surface having a pair of side edges separated by a contoured recess so that when the engaging surfaces are juxtaposed against each other, a maximum distance between the engaging surfaces occurs equidistant between the side edges. A steel bar stock is placed between the engaging surfaces, deforming the bar stock with the engaging surfaces to create a front face and a back face on the bar stock. In one embodiment, each of the contoured recesses is formed as a continuous curved surface from one of the side edges to the other of the side edges. In another embodiment, each of the contoured recesses has a curved portion extending inward from each of the side edges and joins a flat central portion.

In one method, each of the engaging surfaces is a die. When the dies are brought toward each other, a flared portion is created on the bar stock. The flared portion has diverging side edges from a proximal end of the flared portion to a distal end of the flared portion. That method includes shearing to remove each diverging side edge and create a blade tip portion with converging side edges from the proximal end of the flared portion to the distal end of the flared portion. Also, the blade tip portion is sheared perpendicular to an axis of the blade tip portion to provide a selected thickness for a distal end of the blade tip portion.

In another method, each of the engaging surfaces is a metal cutting wheel rotating in opposite directions. The bar stock is inserted between the cutting wheels to remove portions of the bar stock to create the faces of the blade tip.

DETAILED DESCRIPTION

Figure 1:
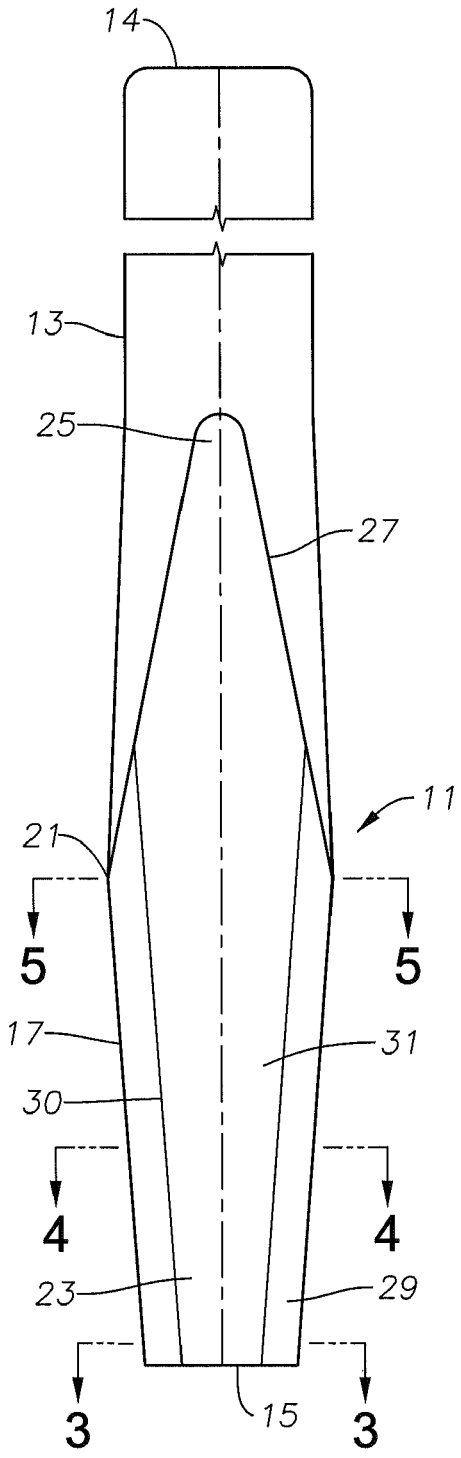
FIG. 1 is a front view of a screwdriver blade constructed in accordance with this disclosure.

Referring to FIG. 1, blade 11 is the lower portion of a screwdriver and will typically have a handle (not shown) affixed to it. Alternately, blade 11 could be a portion that inserts releasably into a socket of a handle. Blade 11 includes a rod or shank 13 that may be cylindrical. Alternately, shank 13 could be polygonal, such as in the shape of a square. Shank 13 has a shank proximal end 14 and a distal end 15. Lower side edges 17 extend along each side edge of blade 11 and join distal end 15. Side edges 17 diverge from distal end 15 in a direction toward shank 13. Typically, the degree of divergence for each side edge 17 is about four degrees relative to a longitudinal axis 19 of shank 13. The width of blade 11 from side edge 17 to the other side edge 17 thus increases in a direction from distal end 15 toward proximal end 14. Distal end 15 is perpendicular to axis 19.

Figure 2:
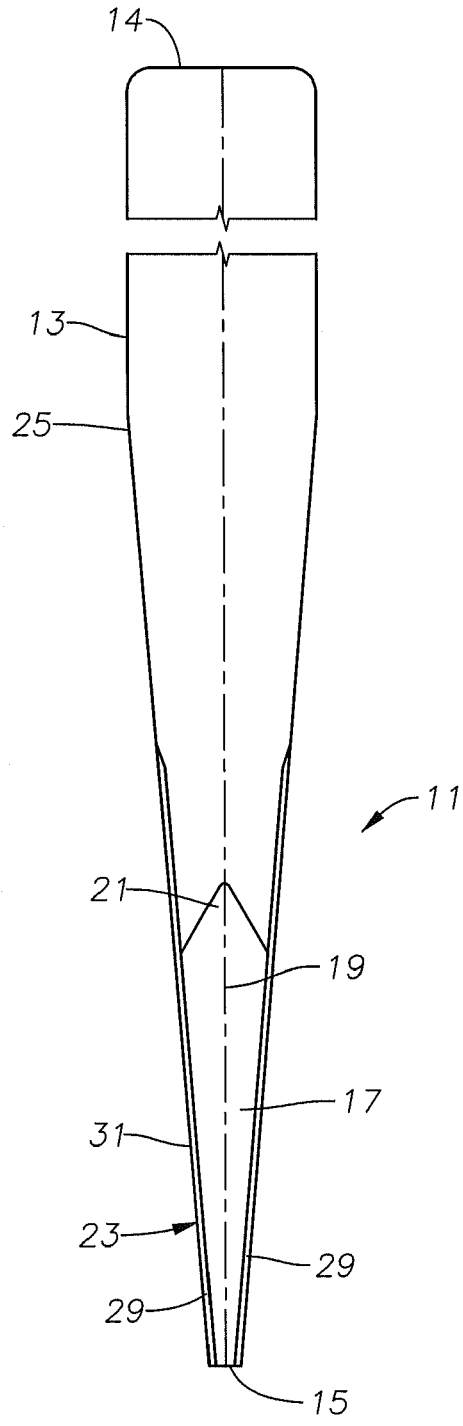
FIG. 2 is a side edge view of the screwdriver blade of FIG. 1.

In this embodiment, upper ends of lower side edges 17 terminate at an obtuse corner or wing 21. The width across blade 11 measured at wings 21 is normally somewhat greater than the diameter of shank 13. However, the width across wings 21 could be equal to the diameter of shank 13. A face 23 is defined by the surface bounded by distal end 15, side edges 17, and an apex or face proximal end 25 that is located farther up shank 13 than wings 15. Face 23 has upper side edges 27 that extend from wings 21 to face proximal end 25 and converge at face proximal end 25. An identical face 23 is located opposite the other; one may be considered to be a back face and the other a front face. In this example, each face 23 inclines relative to axis 19 at about a four degree angle as illustrated in FIG. 2. That is, when viewed in a side edge view as in FIG. 2, each face 23 appears as a straight line. Also, as shown in FIG. 2, the thickness of blade 11 increases from distal end 15 to face proximal end 25.

Figure 3:
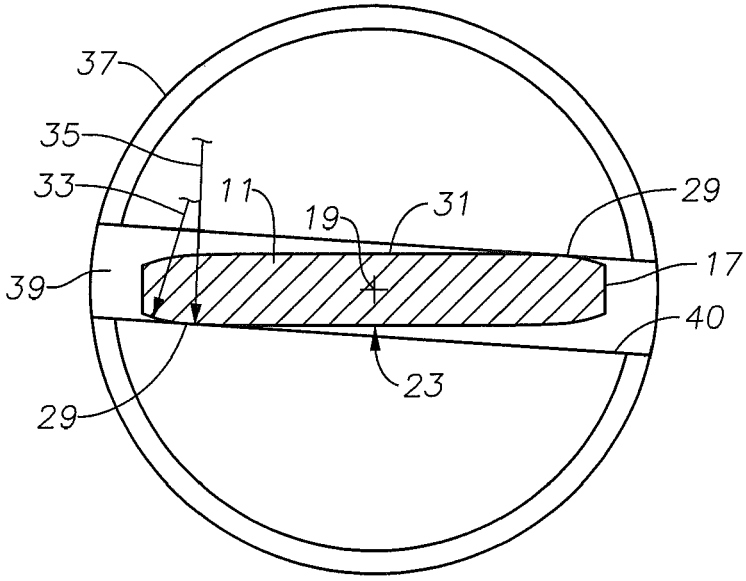
FIG. 3 is a sectional view of the screwdriver blade of FIG. 1, and also showing a screw being engaged by the blade.

In this embodiment, curved driving surfaces 29 are formed on each face 23 adjacent each lower side edge 27. Driving surfaces 29 are curvilinear in that when viewed in a distal end view, as in FIG. 3, they appear curved. When viewed in a side edge view, as shown in FIG. 2, they appear straight. Each driving surface 29 comprises a surface that may be a compound curve having one or more radiuses 33, 35, as shown in FIG. 3. Each driving surface 29 has an inner border or margin 30 that joins a central portion 31 of face 23. Central portion 31 may be flat or it may slightly curve as well. In this embodiment, the radius of each driving surface 29 changes and continuously decreases from margin 30 to side edge 17. The curvatures of driving surfaces 29 may be determined in accordance with U.S. Pat. No. 5,269,209. The portion of blade 11 from face proximal end 25 to distal end 15 may be considered to be the blade tip.

Referring still to FIG. 3, blade distal end 15 is shown in driving engagement with a screw 37 having a straight conventional slot 39 with a flat bottom or base. The side walls 40 of slot 39 are generally parallel to each other and perpendicular to the base of slot 39. However, due to the manufacturing process and tolerances, side walls 40 may be slightly tilted outward from the base, such as at 92 degrees. The distance from one side wall 40 to the other thus is slightly larger at the upper end of slot 39 than at the base. The distance between side walls 40 is also greater than the thickness of blade distal end 15. Radius 35 may be about twenty times the distance between slot side walls 40. Radius 33 may be about ten times the distance between slot side walls 40. Although only two different radiuses are shown, more may be employed. The curvature of driving surface 29 results in a substantial portion of each driving surface 29 being in contact with one of the side walls 40 when torque is applied.

Referring again to FIG. 1, in this embodiment, each inner margin 30 of driving surface 29 is parallel to the closest lower side edge 17. Thus the width of each driving surface 29 from side edge 17 to inner margin 30 is constant from distal end 15 to wings 21. The width of each driving surface 29 reduces from wings 21 to upper side edges 27. The width of each driving surface 29 at distal end 15 is about one-fifth to one-third of the width of distal end 15. Each inner margin 30 continues in a straight angled line from distal end 15 until intersecting one of the upper side edges 27. Since lower side edges 17 diverge relative to axis 19 in a direction from distal end 15 toward shank 13, inner margins 30 also diverge at the same four degree angle. Inner margins 30 are not parallel with upper side edges 27, which converge from wings 21 to face proximal end 25. Each driving surface 29 has a constant width from distal end 15 to the junction with upper side edges 27. Central portion 31 increases in width from distal end 15 until intersecting upper side edges 27.

Figure 4:
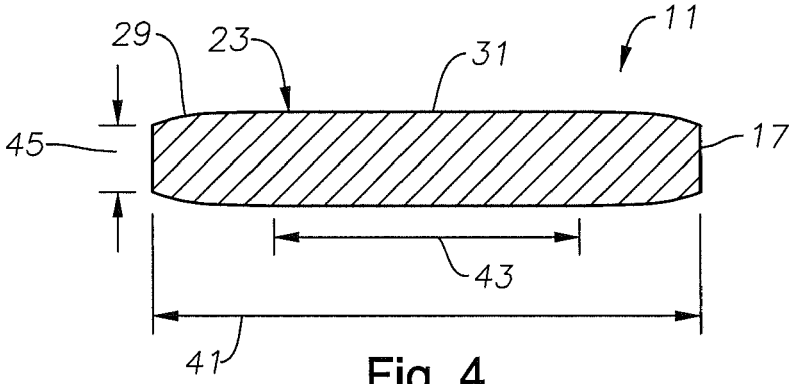
FIG. 4 is a sectional view of the screwdriver blade of FIG. 1, taken along the line 4-4.
Figure 5:
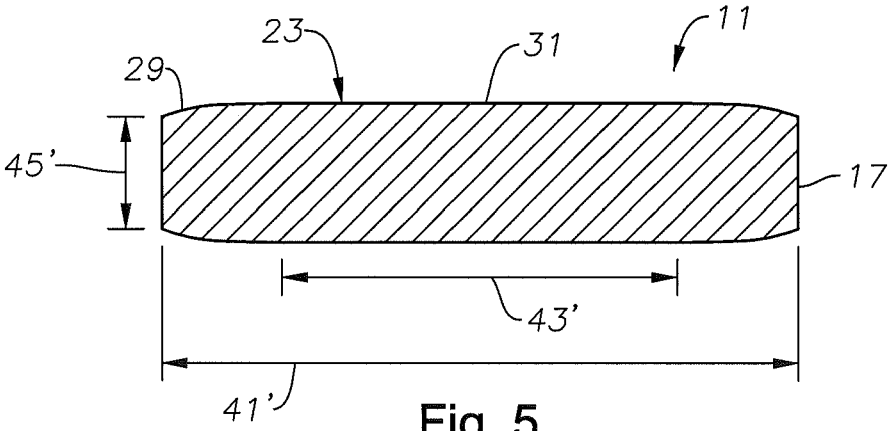
FIG. 5 is a sectional view of the screwdriver blade of FIG. 1, taken along the line 5-5.

Blade 11 not only increases in width from distal end 15 to wings 21; it also increases in thickness from distal end 15 to face proximal end 25, as shown in FIG. 3. The increase in thickness is linear because faces 23 appear flat when view in the side edge view of FIG. 3. As illustrated by comparing FIGS. 4 and 5, the overall width 41 of blade 11 at section line 4-4 in FIG. 1 is less than the overall width 41' at section line 5-5. Width 43 at section line 4-4 is less than width 43' at section line 5-5 of FIG. 1. A thickness 45 of blade 11 measured from the side edge 17 on one face 23 to the side edge 17 on the opposite face 23 increases from distal end 15 to face proximal end 25. Thickness 45' at section line 5-5 is greater than thickness 45 at section line 4-4. The width and thickness increases are due to the four degree angles of side edges 17 relative to axis 19 and the four degree angles of face central portion 31 relative to axis 19. The width and thickness dimensions at section line 4-4 will be greater than the comparable dimensions of the blade 11 taken along the section line 3-3.

Figure 6:
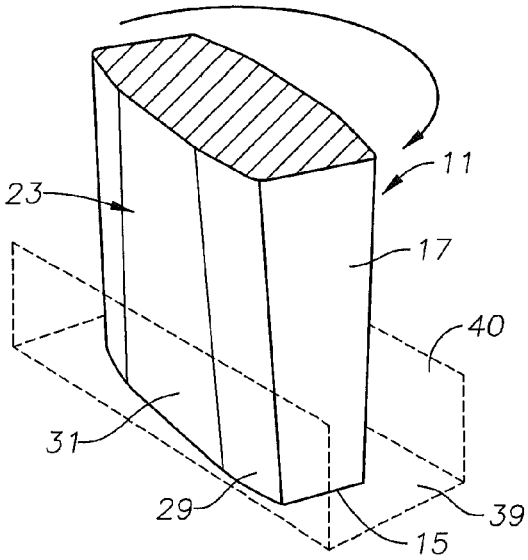
FIG. 6 is an isometric view illustrating a lower portion of the screwdriver blade of FIG. 1 engaging a slot of a screw.

FIG. 6 shows a tip portion of blade 11 in driving engagement with slot 39 illustrated by dotted lines of screw 37 (FIG. 3). One of the driving surfaces 29 on one face 23 of blade 11 is in engagement with one of the slot side walls 40 and one of the driving surfaces 29 on the opposite face 23 (not shown) will be engaging the other slot side wall 40. A substantial portion of these driving surfaces 29 is in contact with one of the side walls 40 of slot 39. Some elastic yielding of side walls 40 may occur when driven with significant torque. Preferably, the yielding is elastic, not permanent.

Figure 7:
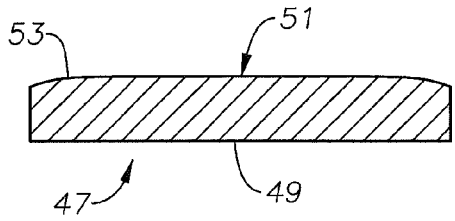
FIG. 7 is a sectional view of an alternate embodiment of a screwdriver blade.

FIG. 7 illustrates a sectional view of an alternate embodiment blade 47. Blade 47 is similar to blade 11 in that it has a contoured face 51 with curvilinear driving surfaces 53 extending inward from each side edge. The opposite face 49 is completely flat and constructed as in a conventional screwdriver. When blade 47 is employed, only one driving surface 53 will be in engagement with a side wall slot since the opposite face 49 does not having curvilinear driving surfaces. However, the alternate embodiment is effective in driving screws without being caromed out of the slots.

Figure 16:
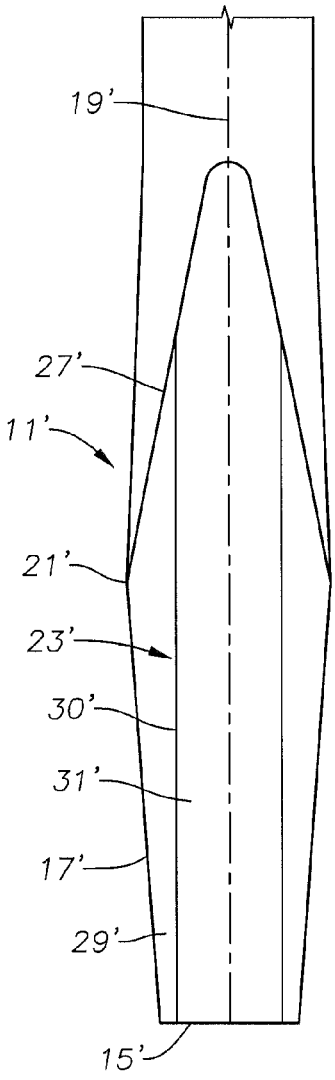
FIG. 16 is a front view of another alternate embodiment of a blade, showing a flat central portion with parallel side edges.

Referring to FIG. 16, blade 11' is similar to blade 11 of FIG. 1, having faces 23' with curvilinear driving surfaces 29' and a flat central portion 31'. Margins 30' of central portion 31' differ from margins 30 in that that are parallel to each other, not to the adjacent side edges 17'. Margins 30 are in parallel planes that are parallel to a plane containing axis 19'. The width of each driving surface 29' thus increases from distal end 15' to wings 21' because of the taper of side edges 17'. The width of central portion 31' is constant from distal end 15' to upper side edges 27'.

Figure 17:
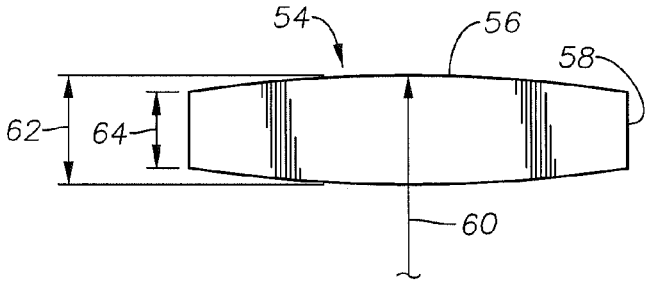
FIG. 17 is a distal end view of a tip of another alternate embodiment of a blade, showing both sides curved at a single and continuous radius.

Referring to FIG. 17, in this embodiment, blade 54 does not have a flat central portion, such as central portion 31'. Rather, each face 56 of blade 54 is a continuous symmetrical curve from one side edge 58 to the other. The radius 60 is quite large relative to the width of blade 54 from one side edge 58 to the other, such as 7½ times for a ¼ inch bit. The thickness 62 of blade 54 at the center may only be about 10 to 20 percent greater than the thickness 64 measured at side edge 58. The curved surface of blade 54 may be formed at a single radius from one side edge 58 to the other. The radius may be selected so that maximum thickness 64 and minimum thickness 62 allow curvature but still fall within the scope of established standards.

For example, Table 1 of ASME (American Society of Mechanical Engineers) Specification B107.15-2002 lists distal end thickness tolerances for screwdriver blades based on width. A ¼" width blade has a specified thickness at the distal end of 0.040" plus or minus 0.0040". If maximum thickness 64 is 0.0044" and minimum thickness 62 is 0.0036", the blade would meet the standard and still have the curved faces. A similar approach may be made for blade 11 (FIG. 1), and blade 11' (FIG. 16).

Figure 18:
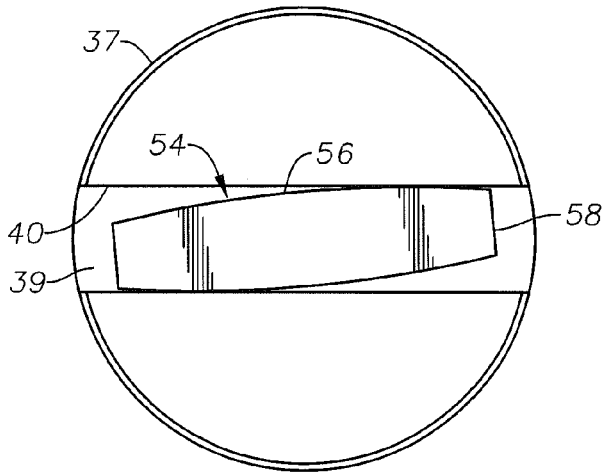
FIG. 18 is a distal end view of the blade of FIG. 17, shown engaging a screw.
Figure 19:
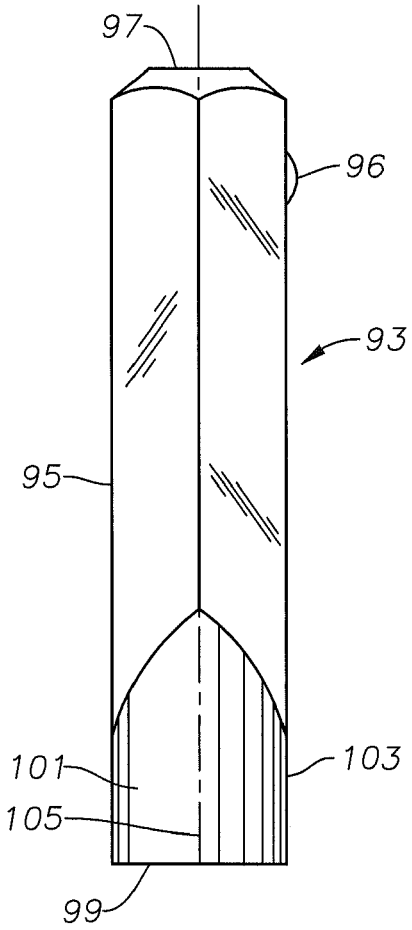
FIG. 19 is a front view of a screwdriver bit in accordance with this disclosure.
Figure 20:
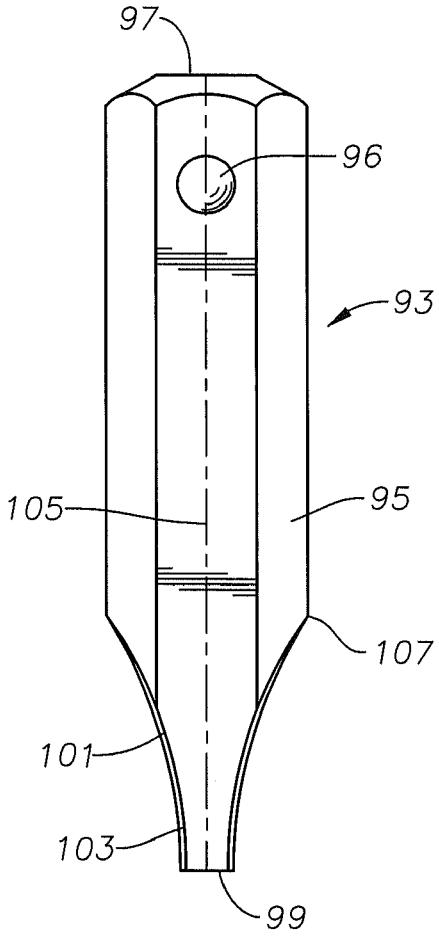
FIG. 20 is a side edge view of the screwdriver bit of FIG. 19.
Figure 21:
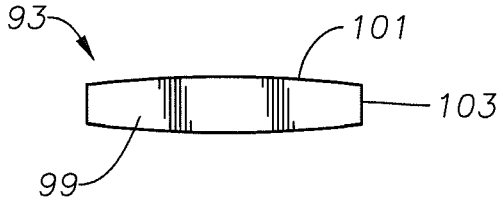
FIG. 21 is a distal end view of the screwdriver bit of FIG. 19.

FIGS. 19-21 illustrate another embodiment of a screwdriver blade 93, which is more commonly referred to as a screwdriver power bit. Bit 93 does not have a handle; rather it is intended to be inserted into the chuck of a drill motor or some other driving tool and rotated by the driving tool. Bit 93 has a shank 95 that may be polygonal. Shank 95 may have a detent 96 nears its proximal end 97. Shank 95 has a distal end 99 opposite proximal end 97. A face 101 is formed on opposite sides of shank 95 to form a tip portion for bit 93. Each face 101 has side edges 103, and the portion between side edges 103 is curved such that the maximum thickness is equidistant side edges 103 as shown in FIG. 21. In this example, the curved surface of each face 101 is continuous from one side edge 103 to the other. The continuous curve may have a single radius, as discussed above in connection with FIGS. 17 and 18. Alternately, the curved surface may be similar to those in FIGS. 1 and 16, defining, two curved driving surfaces separate by a flat central portion. Also, each face 101 curves when viewed in a side view as shown in FIG. 20, thus faces 101 are not curvilinear. Each face 101 curves away from axis 105 from distal end 99 to a proximal end 107 of each face 101. The thickness of bit 93 measured between each face 101 increases nonlinearly from distal end 99 to face proximal end 107.

Figure 8:
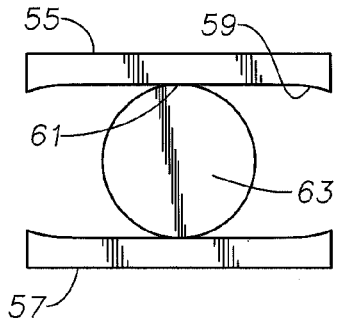
FIG. 8 is a schematic distal end view of a rod placed between two dies in an open position, illustrating a step of one method for forming the screwdriver blade of FIG. 1.
Figure 9:
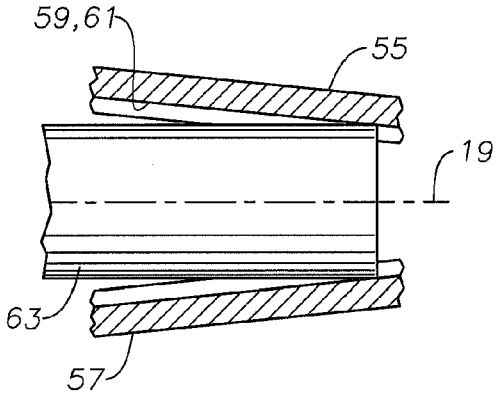
FIG. 9 is a schematic side view of the rod and dies shown in FIG. 8.

Referring to FIG. 8, one method of manufacturing screwdriver blades 11, 11', 47 and 54 is illustrated. Opposed dies or engagement surfaces, referred to as upper and lower dies 55 and 57, have contoured surfaces 59 shaped to form each face 23, 23' or 56. Each contoured surface 59 has two side edges and a central recessed portion. When juxtaposed, as shown FIG. 10, the distance between contoured surfaces 59 is greatest equidistant between the side edges. A cylindrical or rectangular shank or rod 63 of steel alloy is placed between dies 55 and 57. As shown in FIG. 9, dies 55 and 57 are inclined relative to longitudinal axis 19 about four degrees. Dies 55 and 57 are brought together with enough force to permanently deform an end portion of rod 63.

Figure 10:
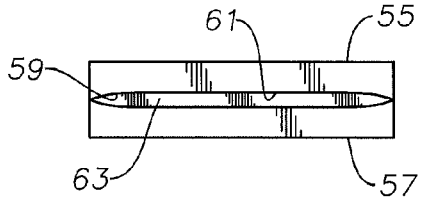
FIG. 10 is a distal end view of the rod and dies in FIG. 8, and showing the dies in a fully closed position.
Figure 11:
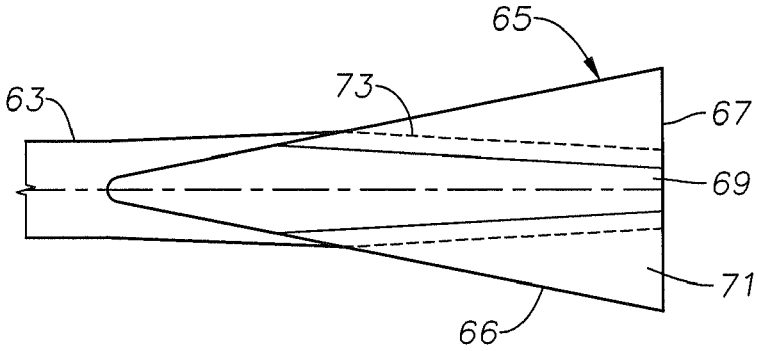
FIG. 11 is a front view of the article formed in the steps illustrated in FIGS. 8-10.

FIG. 10 illustrates a distal end view similar to FIG. 8, but with dies 57 and 55 brought into the closed position. The closure of dies 55, 57 flattens an end portion of rod 63. When removed from dies 55, 57, the end portion of rod 63 will appear as illustrated in FIG. 11. A flared end 65 of generally triangular shape is created with diverging side edges 66. Distal end 67 of flared end 65 has a greater width than the desired final width of a tip for the blade. The thickness of distal end 67 is too thin for the final blade. The movement of dies 55, 57 toward each other creates a flat center portion 69 and curved side portions 71 on flared end 65 if contoured as FIGS. 1 and 16. If engaging surfaces 59 are contoured as FIGS. 17 and 18, a single continuous curved surface would extend from one side edge 66 to the other of flared end 65.

Figure 12:
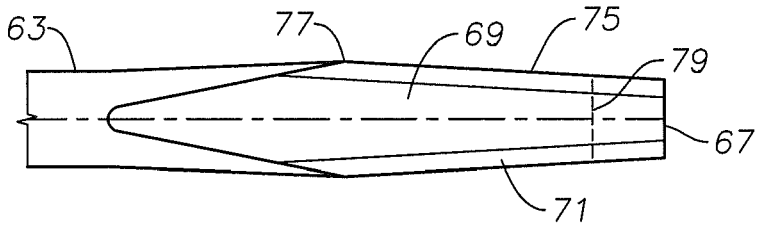
FIG. 12 illustrates the article of FIG. 11 after shearing along dotted lines to define the side edges of the screwdriver blade.
Figure 13:
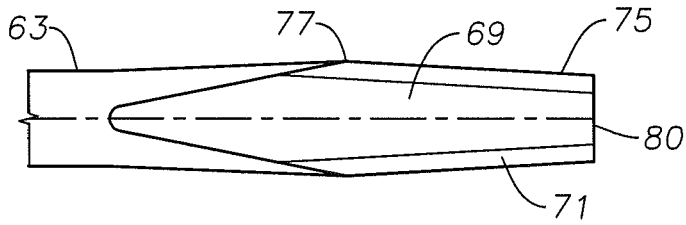
FIG. 13 illustrates the final screwdriver blade after shearing transversely along the article to form the tip of the screwdriver blade.

The next step is to shear flared end 65 along two dotted lines 73. Once sheared, as shown in FIG. 12, diverging side edges 66 are removed and converging side edges 75 of the desired dimensions are created. Also, shearing along dotted lines 73 creates the obtuse corners or wings 77. The next step is to make a transverse shear along line 79 perpendicular to the axis of rod 63. The position of shear line 79 is determined according to the desired thickness for the resulting distal end 80. Shearing along line 79 results in the screwdriver blade having a distal end 80 of desired thickness and width, as illustrated in FIG. 13.

Figure 14:
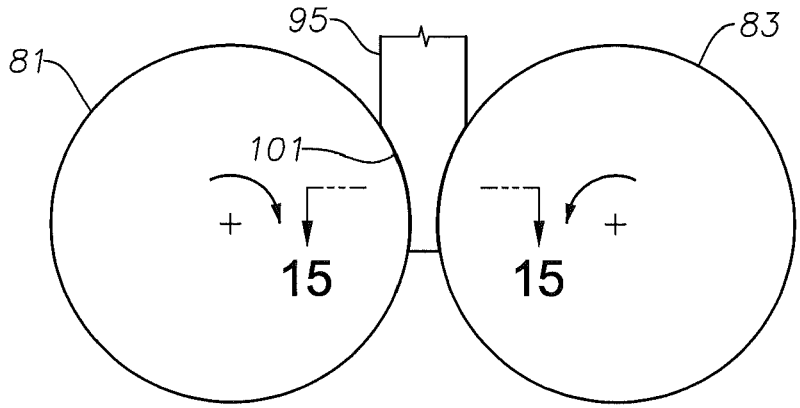
FIG. 14 is a schematic view illustrating a rod being forced between two cutter wheels, which is another method of manufacturing the screwdriver blades.
Figure 15:
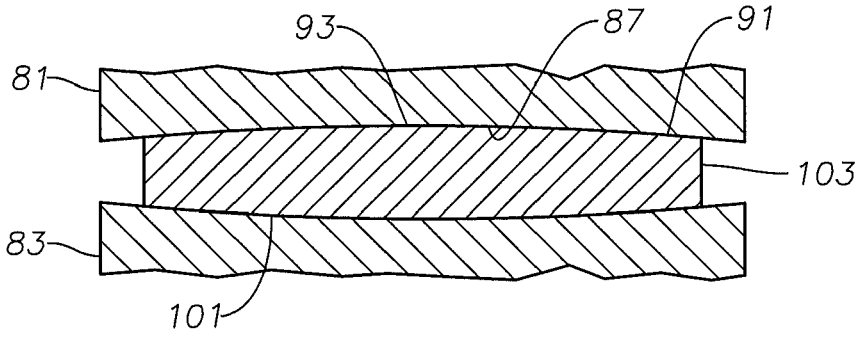
FIG. 15 is a sectional view of the rod and cutter wheels, taken along the line 15-15 of FIG. 14.

FIGS. 14 and 15 illustrate another method of forming screwdriver blade 11, particularly screwdriver bit 93 (FIG. 19). In this technique, rather than dies, the engaging surfaces are two cutter wheels 81 and 83 for cutting or machining metal. Cutter wheels 81 and 83 have cutting surfaces and are rotated in opposite directions. As shown in FIG. 15, cutter wheels 81 and 83 have contoured cutting surfaces 87. Surfaces 87 may comprise a single gradual curve as illustrated. Alternately, the central portions could be flat and joined by curved surfaces. Shank 95 is moved downward a certain distance within a gap between cutter wheels 81 and 83. Cutter wheels 81, 83 cut into shank 95 to create in a single operation screwdriver bit 93.

Screwdriver blades and bits as described meet dimensional specifications of published standards. The blades have better resistance to camming out of a screw slot than prior art blades. The blades require no additional machining steps than are being performed on conventional screwdriver blades. If a tip becomes damaged, the blade can be re-dressed to be re-used.

While only a few embodiments are described, it should be apparent to those skilled in the art that it is not limited to such embodiments, but is subject to variations.

The invention claimed is:

1. A screwdriver blade, comprising:

a shank having a shank proximal end, a shank distal end and a longitudinal axis;

a face formed on a front side of the shank and extending from the shank distal end toward the shank proximal end, the face having two side edges;

a drive surface extending from each side edge inward toward the longitudinal axis, each drive surface being inclined relative to a plane containing the axis and bisecting each of the side edges;

a thickness of the blade measured from each drive surface to a back side of the shank increasing from the shank distal end toward the shank proximal end; wherein:

each drive surface has an inner margin;

a central portion is located between the drive surfaces and joins the inner margins; and each inner margin is a straight line that is parallel to a closest one of the side edges when viewed in a front view, thereby defining a constant width for each of the drive surfaces.

2. The blade of claim 1, wherein a thickness of the blade measured equidistant between the side edges to the back side of the shank increases at a same rate as the thickness of the blade measured from each drive surface to the back side, from the shank distal end toward the shank proximal end.

3. The blade according to claim 1, wherein:

each of the drive surfaces appear curved when viewed in a distal end view; and each of the drive surfaces extends from the shank distal end to a face proximal end.

4. The blade according to claim 1, wherein:

the drive surface and the central portion between each of the drive surfaces appear curved when viewed in a distal end view.

5. The blade according to claim 1, wherein the side edges diverge from each other from the shank distal end toward the shank proximal end.

6. A screwdriver blade, comprising:

a shank having a shank proximal end, a shank distal end and a longitudinal axis;

a face formed on a front side of the shank and extending from the shank distal end toward the shank proximal end, the face having two side edges;

a drive surface extending from each side edge inward toward the longitudinal axis, each drive surface being inclined relative to a plane containing the axis and bisecting each of the side edges;

a thickness of the blade measured from each drive surface to a back side of the shank increasing from the shank distal end toward the shank proximal end; wherein:

the side edges diverge from each other from the shank distal end toward the shank proximal end;

each drive surface has an inner margin;

a central portion is located between the drive surfaces and joins the inner margins; and each inner margin is a straight line, the straight lines being are parallel to each other, thereby defining an increasing width portion for each of the drive surfaces from the shank distal end toward the shank proximal end.

7. The blade according to claim 6, wherein when viewed in a side edge view, the face curves away from the longitudinal axis from the shank distal end to a proximal end of the face.

8. A screwdriver blade, comprising:

a shank having a shank proximal end, a shank distal end and a longitudinal axis;

a front face formed on a front side of the shank and a back face formed on a back side of the shank, each of the faces extending from the shank distal end toward the shank proximal end, and each of the faces having two side edges; and each of the faces being a curved surface extending continuously from one of the side edges to the other of the side edges, such that a maximum thickness of the blade measured from the front face to the back face at the shank distal end is located equidistant between the side edges.

9. The blade according to claim 8, wherein the curved surface is formed at a single radius.

10. The blade according to claim 8, wherein the curved surface extends from the shank distal end to a face proximal end of each of the faces.

11. The blade according to claim 8, wherein a thickness of the blade measured at each of the side edges between the front and back faces increases from the shank distal end to toward the shank proximal end.

12. The blade according to claim 8, wherein each of the faces is curvilinear so that when viewed in a side view, each of the faces appears as a straight line.

13. The blade according to claim 8, wherein when viewed in a side view, each of the faces appears as a curved line.

14. A method of manufacturing a screwdriver blade, comprising:

(a) preparing a metal forming tool with two engaging surfaces, each engaging surface having a pair of side edges separated by a contoured recess so that when the engaging surfaces are juxtaposed against each other, a maximum distance between the engaging surfaces occurs equidistant between the side edges; and (b) placing a steel bar stock between the engaging surfaces, and deforming the bar stock with the engaging surfaces to create a front face and a back face on the bar stock.

15. The method according to claim 14, wherein each of the contoured recesses is formed as a continuous curved surface from one of the side edges to the other of the side edges.

16. The method according to claim 14, wherein each of the contoured recesses has a curved portion extending inward from each of the side edges and a flat central portion.

17. The method according to claim 14, wherein:

each of the engaging surfaces comprises a die;

step (b) results in a flared portion on the bar stock, the flared portion having diverging side edges from a proximal end of the flared portion to a distal end of the flared portion; and the method further comprises:

shearing each diverging side edge to create a blade tip portion with converging side edges from the proximal end of the flared portion to the distal end of the flared portion; and shearing the blade tip portion perpendicular to an axis of the blade tip portion to provide a selected thickness for a distal end of the blade tip portion.

18. The method according to claim 14, wherein each of the engaging surfaces comprises a metal cutting wheel.

* * * * *